US007695415B2

(12) United States Patent
Goel et al.

(10) Patent No.: US 7,695,415 B2
(45) Date of Patent: Apr. 13, 2010

(54) TRUNK ROTATION

(75) Inventors: Vijay K. Goel, Holland, OH (US); Danny M. Pincivero, Toledo, OH (US); David Dick, Whitehouse, OH (US); John Jaegly, Northwood, OH (US); F. Alan Schultheis, Redding, CT (US); Kathleen Herndon, Raleigh, NC (US)

(73) Assignees: University of Toledo, Toledo, OH (US); The Turning Point LLC, Redding, CT (US)

( * ) Notice: Subject to any disclaimer, the term of this patent is extended or adjusted under 35 U.S.C. 154(b) by 1282 days.

(21) Appl. No.: 11/200,358

(22) Filed: Aug. 9, 2005

(65) Prior Publication Data

US 2007/0037663 A1 Feb. 15, 2007

(51) Int. Cl.
*A63B 21/00* (2006.01)

(52) U.S. Cl. ..... 482/136; 473/216; 482/92

(58) Field of Classification Search ..... 482/100–104, 482/130–136, 92, 125–127; 473/216
See application file for complete search history.

(56) References Cited

U.S. PATENT DOCUMENTS 3,429,571 A * 2/1969 Abel, Jr. ..... 473/212
4,318,546 A * 3/1982 Chen ..... 473/216
4,733,860 A * 3/1988 Steffee ..... 482/136
4,893,811 A * 1/1990 Dilmore ..... 482/5
5,050,885 A * 9/1991 Ballard et al. ..... 473/216
5,052,684 A * 10/1991 Kosuge et al. ..... 482/118
5,094,249 A * 3/1992 Marras et al. ..... 600/594
5,324,247 A * 6/1994 Lepley ..... 482/134
5,941,807 A 8/1999 Cassidy et al.
5,957,816 A 9/1999 Staffa
6,077,241 A * 6/2000 Fareed ..... 602/62
6,537,184 B2 * 3/2003 Kim ..... 482/122
RE38,057 E * 4/2003 Pandozy ..... 482/97
6,579,214 B2 6/2003 Crump
6,726,608 B1 * 4/2004 Hsu ..... 482/130
6,786,855 B2 * 9/2004 Prichard ..... 482/127

* cited by examiner

*Primary Examiner*—Fenn C Mathew
(74) *Attorney, Agent, or Firm*—Emch, Schaffer, Schaub & Porcello Co., L.P.A.

(57) ABSTRACT

This trunk rotation device uses dynamic movement of one's body such as, shoulder, hip, knee, back, thigh, and abdominal musculature. The device provides a method for exercising the spinal column and the muscles of the torso, including those in the abdominal lumbar and thoracic regions involving rotational torque. In a preferred embodiment, the device is a golf exercise and flexibility apparatus. The golf exercise apparatus provides resistance to a golfer during a golf swing to strengthen and condition the muscles of the axial skeleton of the golfer in a functional posture.

24 Claims, 12 Drawing Sheets

TRUNK ROTATION

FIELD OF THE INVENTION

The present invention relates generally to devices using dynamic movement of one's body. The invention may be used for shoulder, hip, knee, back, thigh and abdominal musculature and the like. The invention relates more specifically to a device and method for exercising and developing greater flexibility of the spinal column and the muscles of the torso, including those in the abdominal lumbar and thoracic regions involving rotational torque in a function posture.

BACKGROUND OF THE INVENTION

In a general embodiment, the invention relates to an exercise and flexibility apparatus that may keep the body in good shape. In a preferred embodiment, the invention relates to a golf exercise and flexibility apparatus, and particularly to golf exercise apparatus which provides resistance to a golfer during a golf swing to strengthen and condition the muscles of the axial skeleton of the golfer.

While this invention is described in terms of exercise and golf, the device may be used broadly for general conditioning, physical therapy and other sports such as swimming, tennis and the like where conditioning and flexibility are desirable. In one embodiment, this invention helps to prevent or minimize minor muscle aches and pains.

Currently, golf is an activity enjoyed by many people of all ages possessing varying degrees of athletic ability, musculoskeletal strength, flexibility and endurance. Although it is possible to perform a golf swing without having excessive musculoskeletal support, greater bodily strength, flexibility and endurance allows a golfer to hit a golf ball farther and with greater accuracy and consistency and to minimize minor muscle related aches and pains.

External devices are currently being marketed to help train the muscles of the golfer to move along a predetermined path which is thought to be along an optimal golf swing path. These devices restrict the swing path of the golfer to a plane within which it is thought necessary to maintain the golf club throughout the golf swing. However, no resistance is supplied in the direction of rotation of the shoulders and upper torso, the hips, and upper legs of the golfer during performance. These devices are not designed to benefit muscular conditioning or flexibility.

Regular exercise may keep the body in good shape, but not all exercise is equally effective. Many exercise devices on the market, particularly in health and athletic clubs, are less effective than patrons may assume, particularly as related to the rotational movements required in golf and similar activities. The problem is that most available equipment in health clubs train in predominantly linear, single plane movement and are limited to isolating one muscle group. The body rarely moves in just one plane and often requires multiple muscle groups to work together. Most body movement involves rotation and diagonal patterns of movement.

The need exists for an exercise, conditioning and rehabilitation device which permits activity consisting of components of motion in all three planes, and permits isolation of a specific area of the body, the motion of which is most desired. Such a device will permit a physical therapist, chiropractor or trainer or other instructional devices to tailor the activity of the user to the goals of the user.

SUMMARY OF THE INVENTION

The device of this invention is a golf exercise and conditioning apparatus that provides resistance during an exercise emulating the movements required of a golf swing of a golfer to strengthen and condition the muscles of the axial skeleton and lower extremities of the golfer performing the exercise. The device includes a support base; a member pivotally mounted to the support base; a torso pivotally mounted axial shaft coupled to the pivotally mounted member; and a pelvis pivotally mounted axial shaft coupled to the pivotally mounted member. A shoulder harness is connected to the torso axial shaft; and a hip harness is connected to the pelvis axial shaft. A torso, independent torque resistor is connected to the torso axial shaft and includes a means for providing resistance in at least two directions.

A pelvis, independent torque resistor also is connected to the pelvis axial shaft, and includes a means to provide resistance in at least two directions. In a preferred embodiment, the apparatus includes a means to independently lock the torso shaft in a neutral position and a means to independently lock the pelvis shaft in a neutral position.

The advantage of this new device is that it offers user-determined variable resistance in a standing, functional position. The inclination angle from the vertical can be modified by the user to better replicate posture in various sports such as golf, hockey, or baseball. Other devices designed to enhance trunk muscle rotator strength, places the user in a seated position which restricts pelvic motion and distributes a greater proportion of the imposed stress to the vertebrae, thereby increasing the potential for injury. The invention provides resistance to trunk and pelvic rotation without restricting the natural rotational movement of the trunk and pelvis. The present devices do not allow the user to undertake strength exercises in a functional posture at all.

The exercise apparatus of this invention provides resistance in a direction of movement and resistance in a direction opposite of movement. The apparatus comprises means to provide the movement; means to control the resistance; and means to manage the movement. The method that provides resistance in a direction of movement and resistance in a direction opposite of movement comprises the steps of providing an exercise apparatus; locating a user in the apparatus to provide movement; providing resistance to the movement; controlling the resistance to the movement; and managing the movement.

Other objects and advantages of the present invention will become apparent to those skilled in the art upon a review of the following detailed description of the preferred embodiments and the accompanying drawings.

DESCRIPTION OF THE INVENTION

The trunk rotation conditioning device of this invention provides the following. The user is in a weight bearing position that simulates a stance in many sports (e.g., golf, baseball or hockey). The angle of the inclination (posture) is adjustable about a pivot to accommodate individual variation in the standing position.

Figure 1:
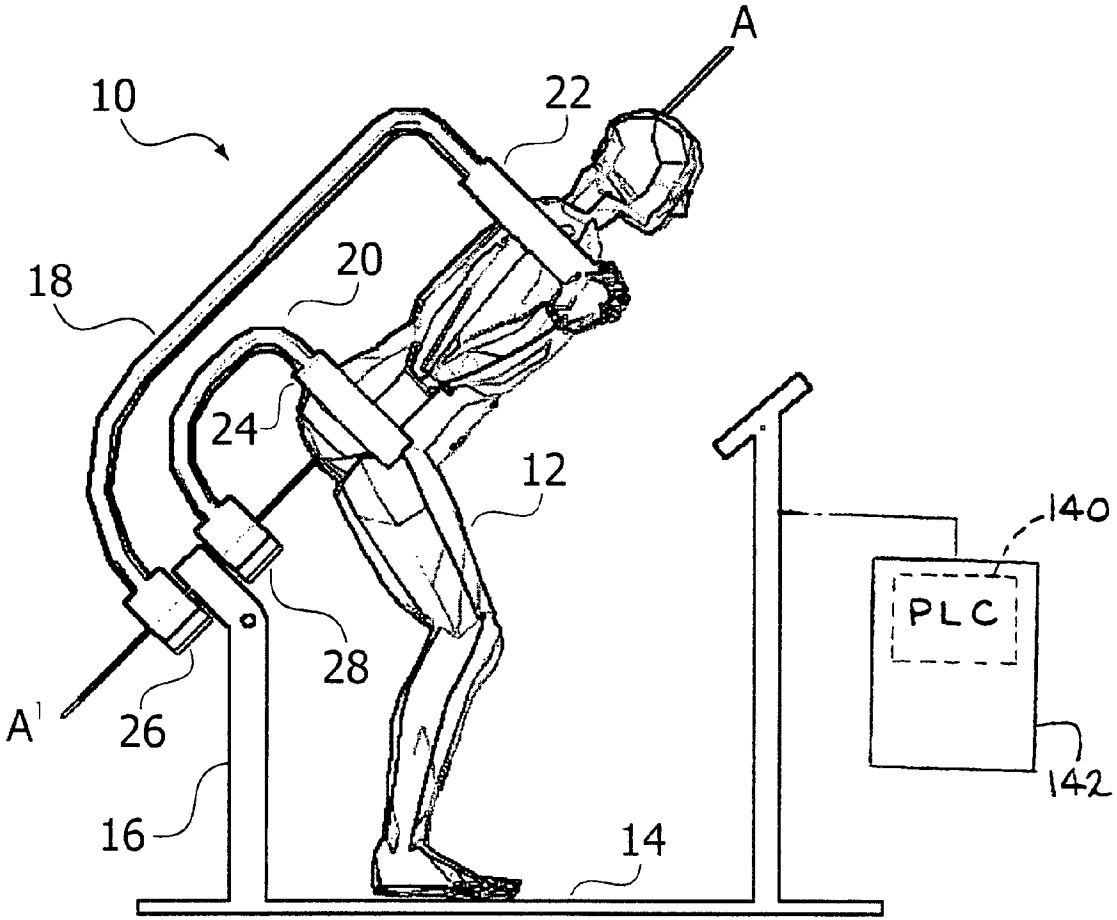
FIG. 1 is a side view illustrating the basic elements of the trunk rotation conditioning device, as well as the position of the user and how it can accommodate to user size.

FIG. 1 is a side view illustrating the basic elements of the trunk rotation conditioning device, as well as the position of the user and how it can accommodate to user size. In the preferred embodiment of a golf exercise apparatus, the device provides resistance during an exercise emulating a golf swing of a golfer to strengthen muscles of the axial skeleton and lower extremities of the performing golfer.

FIG. 1 shows exercise apparatus 10 that provides resistance during an exercise using dynamic movement for shoulder, hip, knee, back and abdominal musculature to strengthen muscles of the axial skeleton and lower extremities of performing user 12. Apparatus 10 comprises support base 14, member 16 pivotally mounted to the support base, variable resistance, torso pivotally mounted axial shaft 18 coupled to pivotally mounted member 16, shoulder harness 22 connected to torso axial shaft 18, hip harness 24 connected to pelvis axial shaft 20, torso independent torque resistor 26 connected to torso axial shaft 18, and pelvis, independent torque resistor 28 connected to pelvis axial shaft 20. The angle of inclination (posture) is adjustable along axis A-A'.

FIG. 1 illustrates the standing neutral position of the user in the device. The user is strapped at the shoulder and hip using restraints which are connected rigidly to the arms that rotate about the axis "A" at pivots points. The length of these arms is adjustable to accommodate users of different sizes/heights.

FIG. 1 also shows controller 140 and computer 142 operating exercise apparatus 10 through conventional circuitry, not shown. Controller 140 and computer 142 are wired to their respective drives, sensors and actuators in apparatus 10 through conventional circuitry, not shown.

Figure 2:
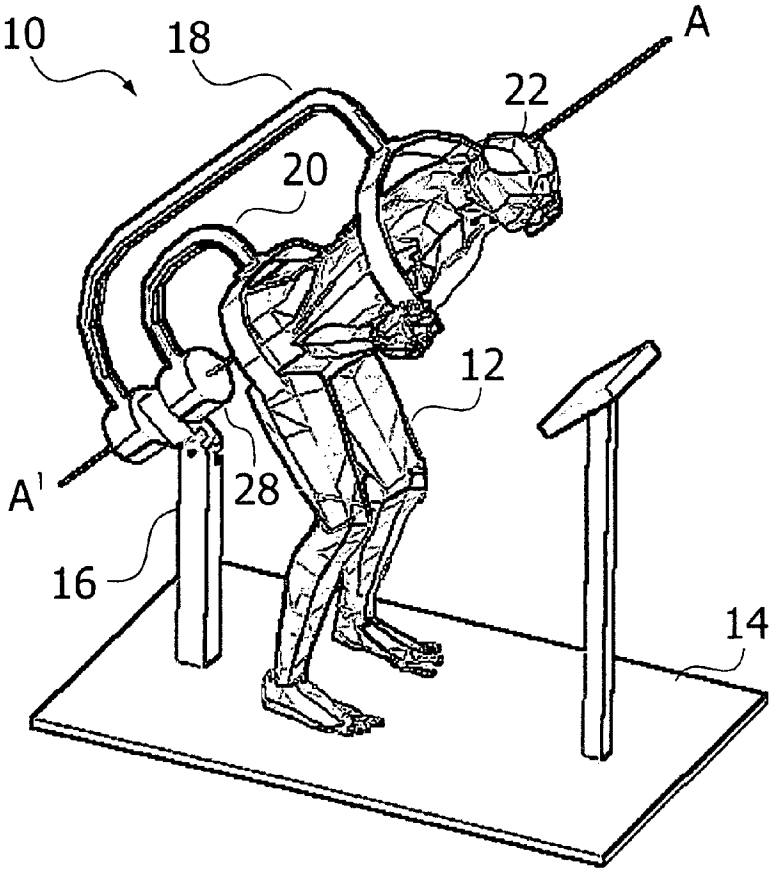
FIG. 2 is a side view in perspective illustrating the hips and shoulders of the user.

FIG. 2 is a side view in perspective illustrating the hips and shoulders of user 12. The hip and shoulder turn are shown in greater detail in FIG. 3. Apparatus 10 includes a support base, a member pivotally mounted to the support base; a torso pivotally mounted axial shaft coupled to the pivotally mounted member; and a pelvis pivotally mounted axial shaft coupled to the pivotally mounted member as described for FIG. 1.

Figure 3:
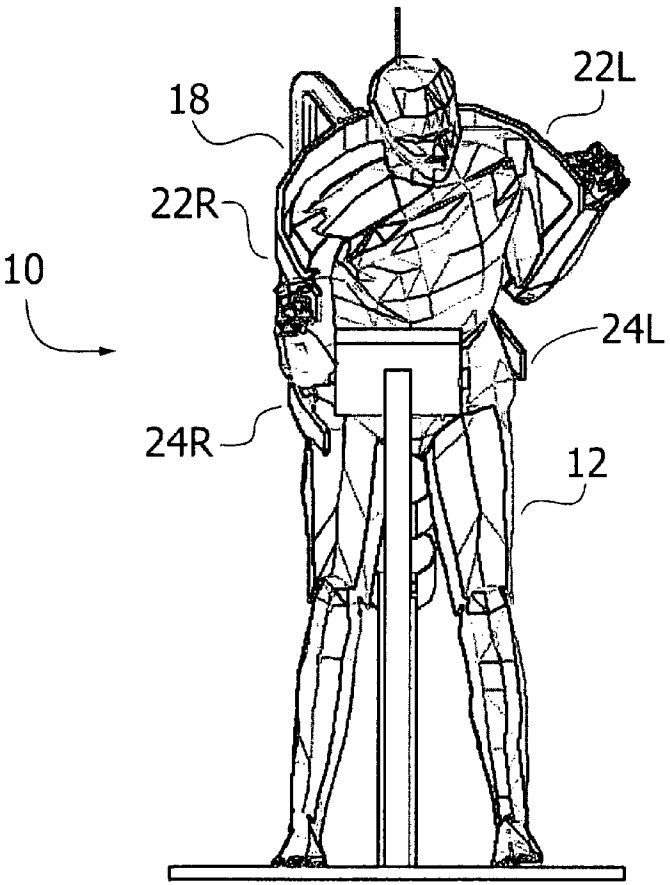
FIG. 3 is a front view of the perspective illustration of FIG. 2 showing the user turned to the left.

FIG. 3 is a front view of the prospective illustration showing a shoulder and hip turn to the left. The user locates himself/herself in this posture within machine 10 such that the axis A-A' of rotation of the exercise motion passes through user's 12 spine, the desired axis of rotation of the hips and shoulders. FIG. 3 shows shoulder harness portion 22 L and hip harness portion 24L turned upwardly and to the left. Also shown in shoulder harness portion 22R and hip harness portion 24R turned downwardly and to the left.

Figure 4:
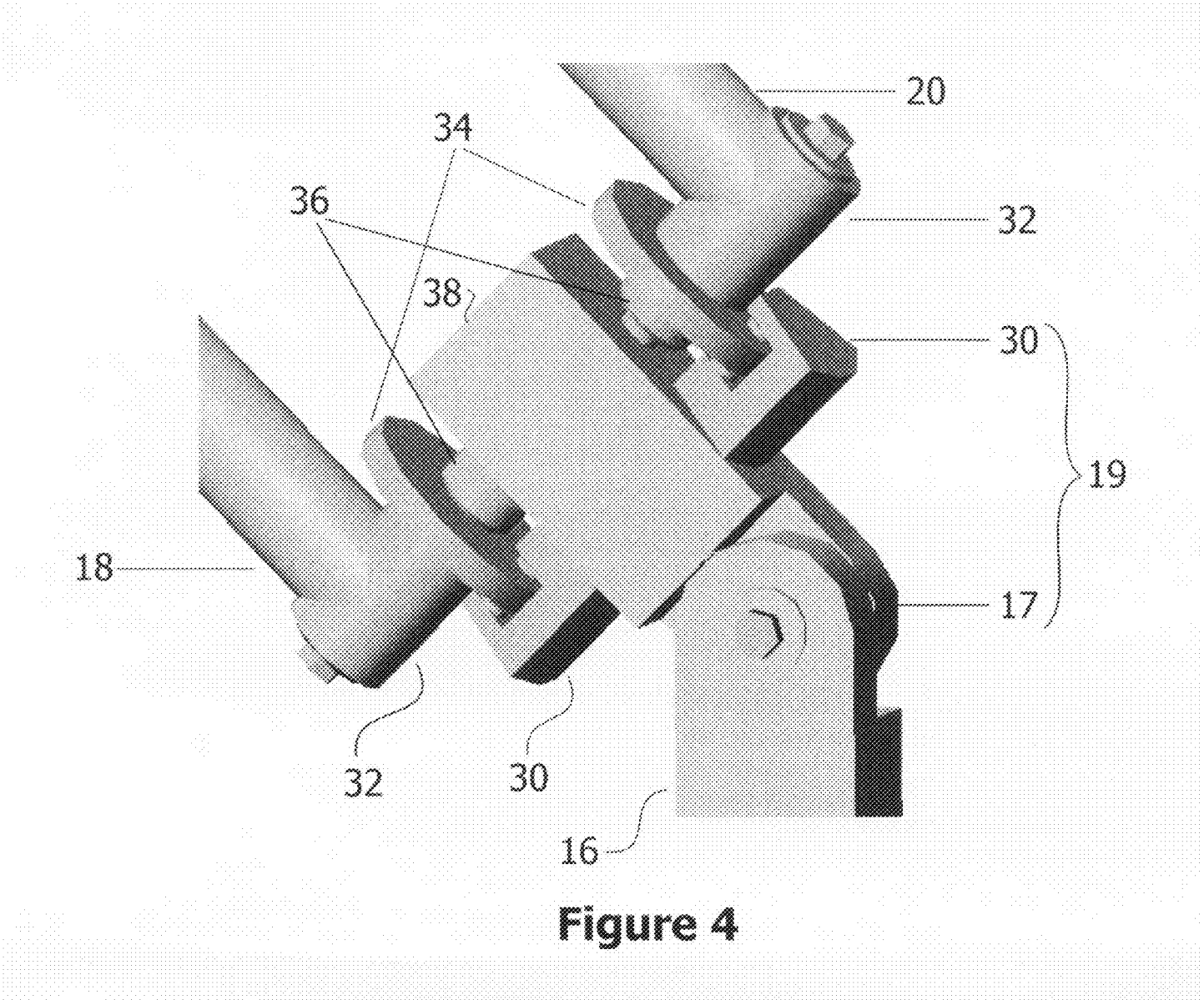
FIG. 4 is a view showing the resistance means that provide the resistance to rotation at the torso and pelvis resistance arm axes of movement.

FIGS. 2 and 3 illustrate the torso and pelvis rotation of the user towards the left. A shoulder harness is connected to the torso axial shaft; and a hip harness is connected to the pelvis axial shaft. A torso, independent force resistor is connected to the torso axial shaft and includes a means for providing resistance in at least two directions. The hips and shoulders are provided with variable resistance about the pivots in the form of disc brakes (FIG. 4). These brakes can be in the form of dry friction, fluid damping, eddy currents, or magneto-heterodyne. The braking will provide resistance in either direction across the range of possible movement.

FIG. 3 is a front view that illustrates torso and pelvis rotation of the user towards the left. A pelvis, independent force resistor also is connected to the pelvis axial shaft, and includes a means providing resistance in at least two directions. In a preferred embodiment, the apparatus includes a means to independently lock the torso shaft in a neutral position and a means to independently lock the pelvis shaft in a neutral position. Linear potentiometers are provided at the pivots points to measure the angular position of the torso and pelvis. Load cells are located at the pivots to measure the exerted force of the user, independently at the torso and pelvis.

FIG. 4 is a view showing the hydraulic disk brakes. In another embodiment, magnetic brakes will be shown that provide the resistance to rotation at the torso and pelvis resistance arm axes of movement. The machine has the following additional attributes. The resistance of the shoulders and hips are independently adjustable, and will be user determined and controlled, via a control panel within reach of the user while in the device. The torso and pelvis pivot arms can be independently locked in the neutral position in order to isolate the exercise to the other element.

FIG. 4 shows resistor 26 and 28 in greater detail. Resistors 26 and 28 each comprise caliper 30, pivot arm 32, rotor 34 and torque and angle measurement device 36. These connect shaft 18 and 20 to member 16 through housing 38. A real-time digital display unit will be provided to the user regarding the position and torque exerted by the torso and pelvis. The maximum difference between the torso and pelvis angle will be calculated and displayed for each exercise cycle.

FIG. 4 also shows axial assembly 19 in greater detail. Axial assembly 19 connects arm 18 and arm 20 to member 16 through housing 38. FIG. 4 also shows adjustable torso angle control 17 connected to member 16 via housing 38.

Figure 5:
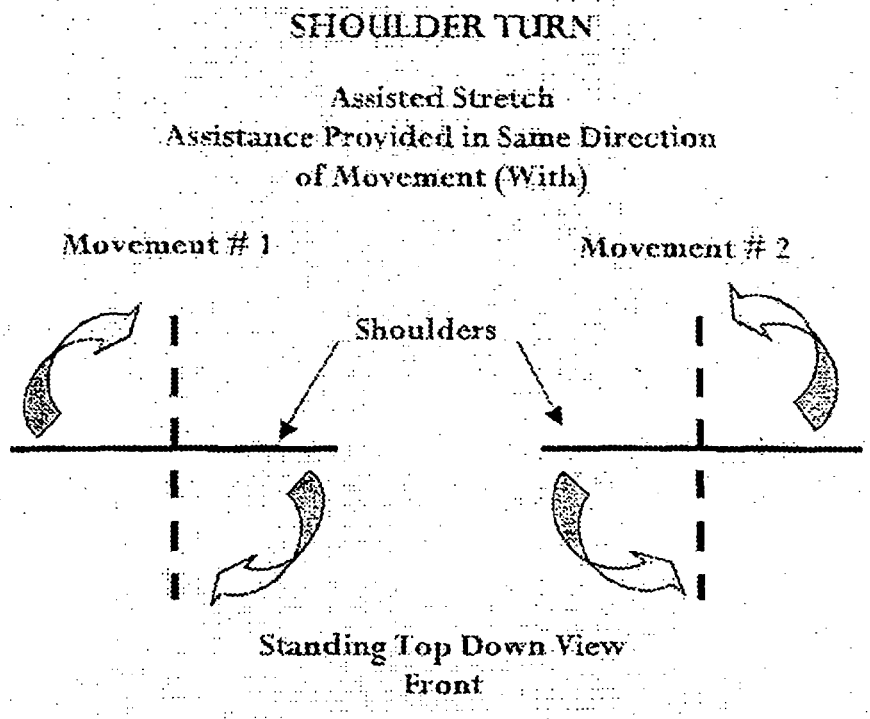
FIG. 5 illustrates shoulder turn according to this invention.
Figure 5:
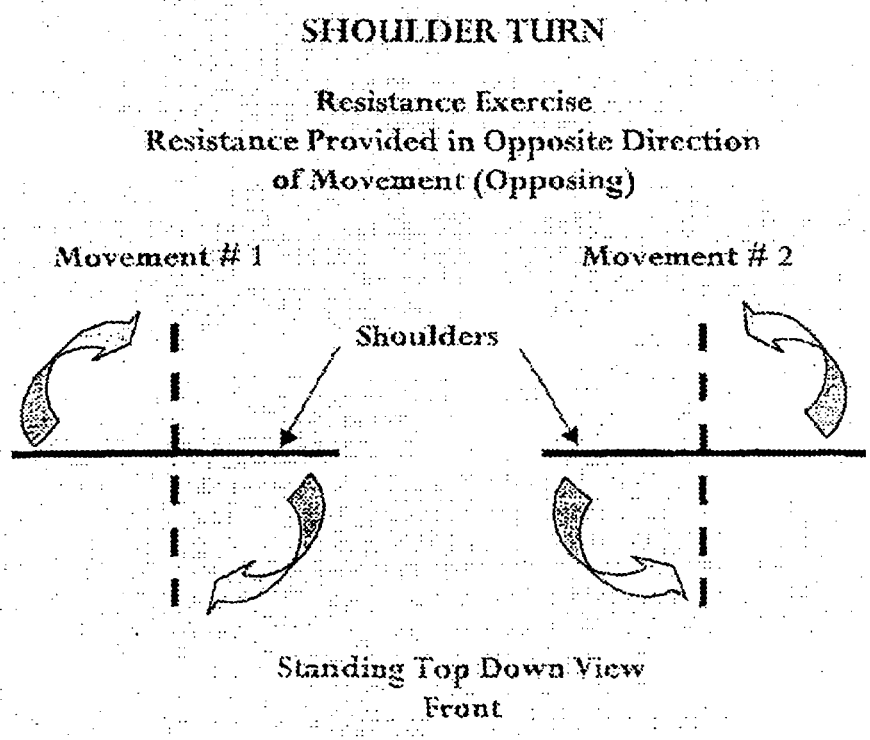

FIG. 5 illustrates shoulder turn according to this invention. The exercise apparatus provides resistance during an exercise using dynamic therapeutic movement for shoulder, hip, knee, back and abdominal musculature to strengthen muscles of the axial skeleton and lower extremities of a performing user. It includes a means for providing adjustable resistance in all directions and adjustable assisted stretching in all directions.

Figure 6:
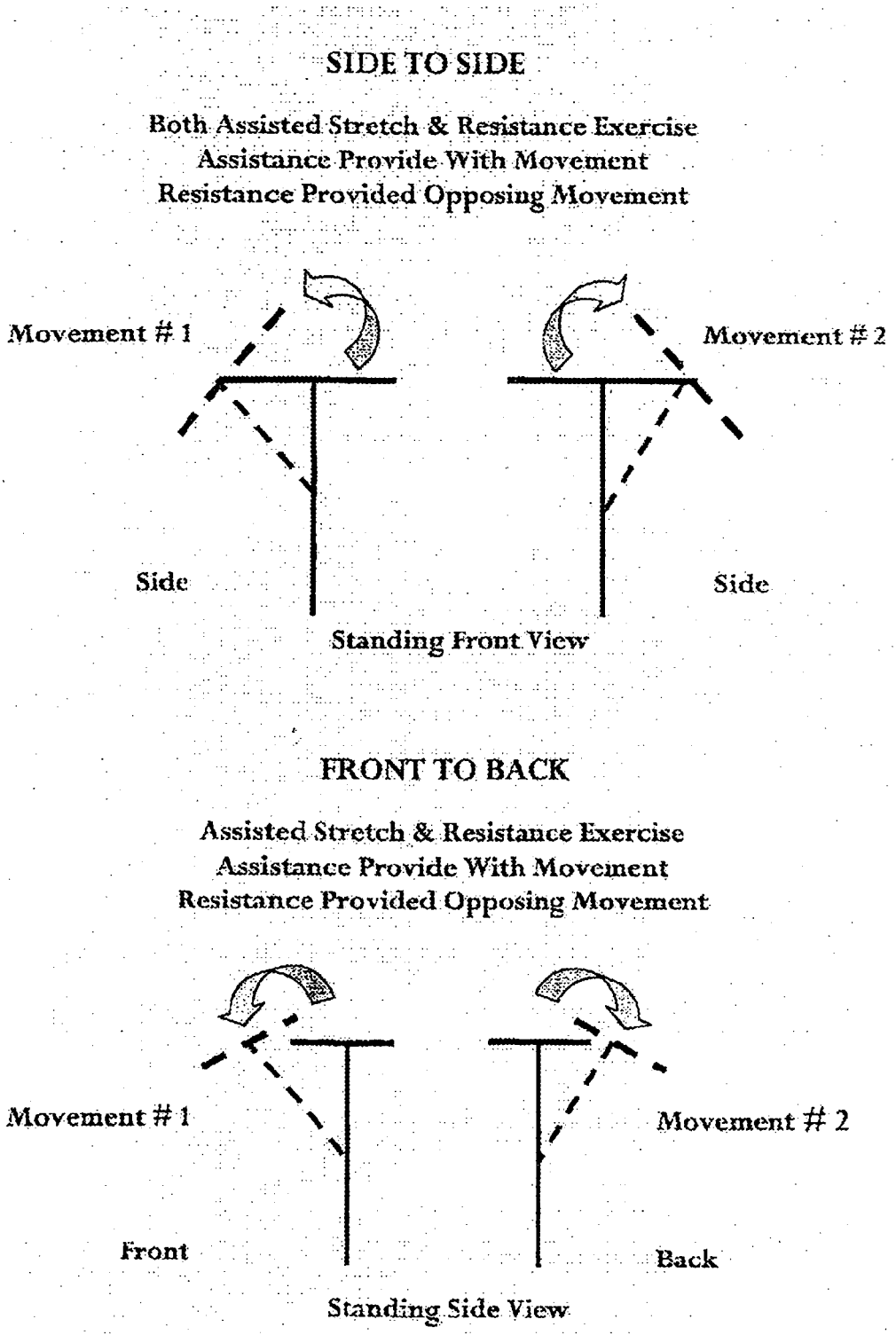
FIG. 6 illustrates side to side and front to back rotation according to this invention.

FIG. 6 illustrates side to side and front to back rotation according to this invention. The method includes steps of: providing an exercise apparatus that provides resistance during an exercise using dynamic therapeutic movement for shoulder, hip, knee, back and abdominal musculature to strengthen muscles of the axial skeleton and lower extremities of a performing user; and providing adjustable resistance in all directions and adjustable assisted stretching in all directions.

Figure 7:
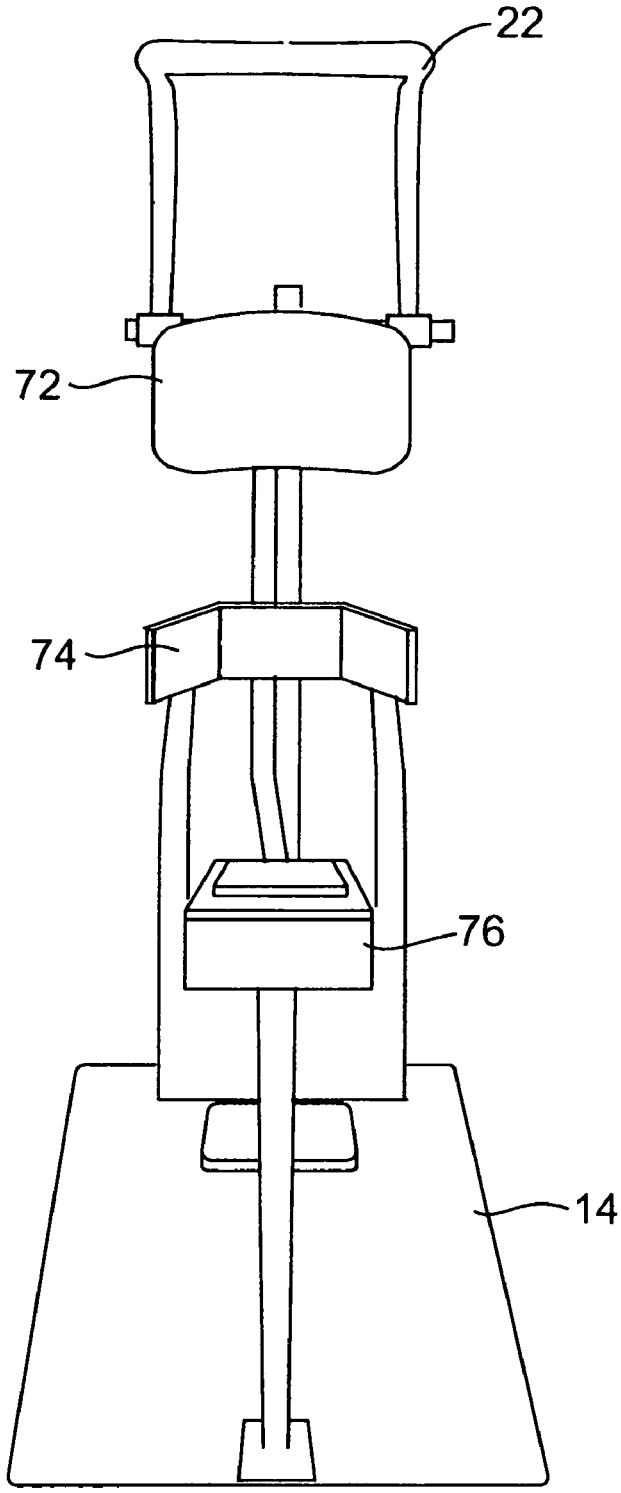
FIG. 7 is a front view showing the preferred embodiments of back supports and a real time display unit.

FIG. 7 is a front view showing the preferred embodiments including back supports and a real time display unit. FIG. 7 shows shoulder harness 22, upper back support 72, lower back support 74, real time display unit 76 and support base 14. Display unit 76 preferably is positioned where the user may view the display. Display unit 76 is connected to controller 140 and computer 142 through conventional circuitry, not shown.

Figure 8:
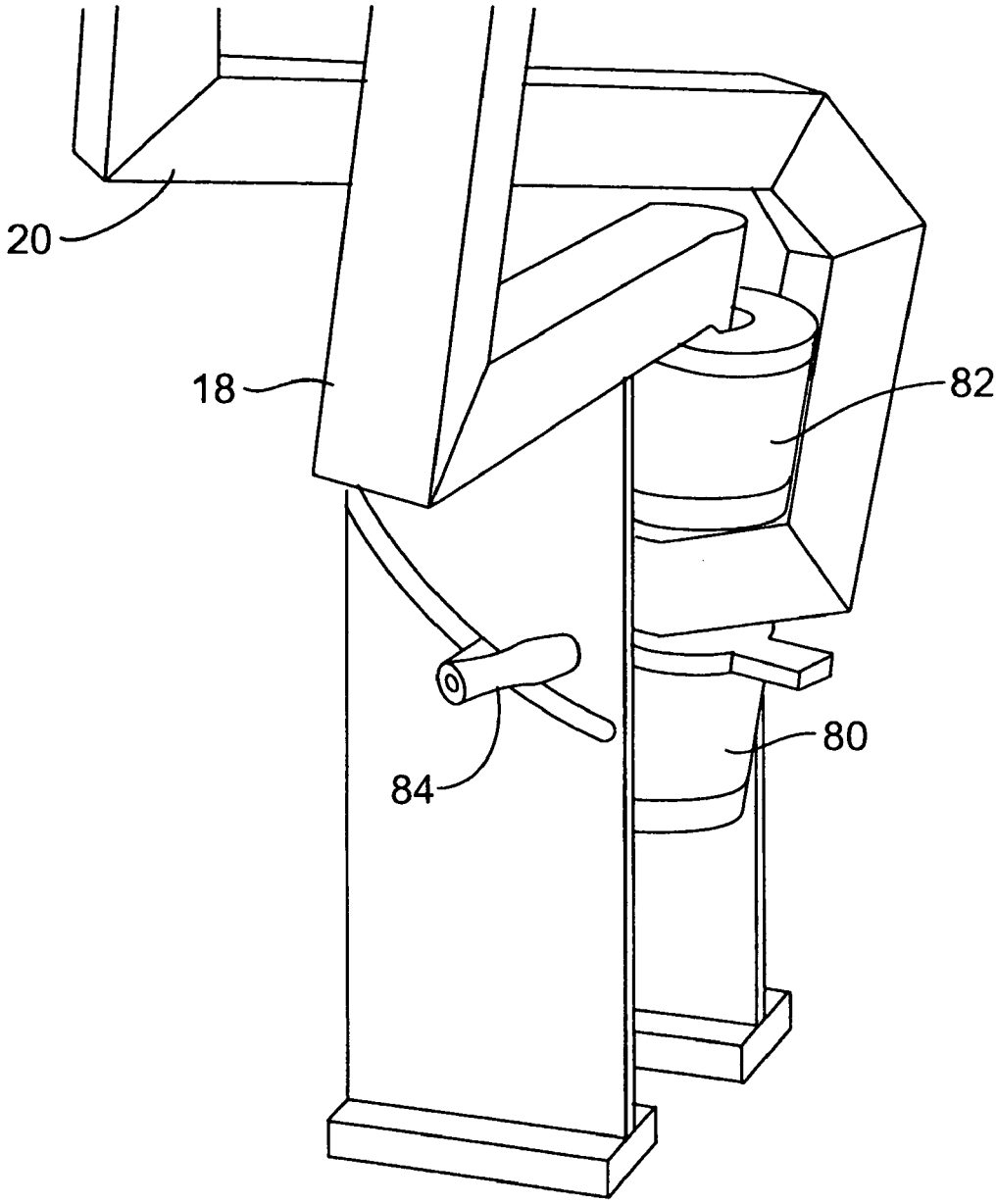
FIG. 8 is a sectional view showing the preferred embodiments of magnetic brakes and an adjustable torso angle control.

FIG. 8 is a sectional view showing the preferred embodiments of magnetic brakes and an adjustable torso angle control. FIG. 8 shows upper back arm 18 and lower back arm 20 connected to magnetic brakes 80 and 82. Magnetic brakes 80 and 82 replaces the disc or resistance brakes shown in FIG. 4. Member 16 supports and houses magnetic brakes 80 and 82. Member 16 also supports and houses control 84 which provides an adjustable torso angle to apparatus 10. Adjustable torso angle 84 comprises a lever, slot and rod for controlling torso angle.

Figure 9:
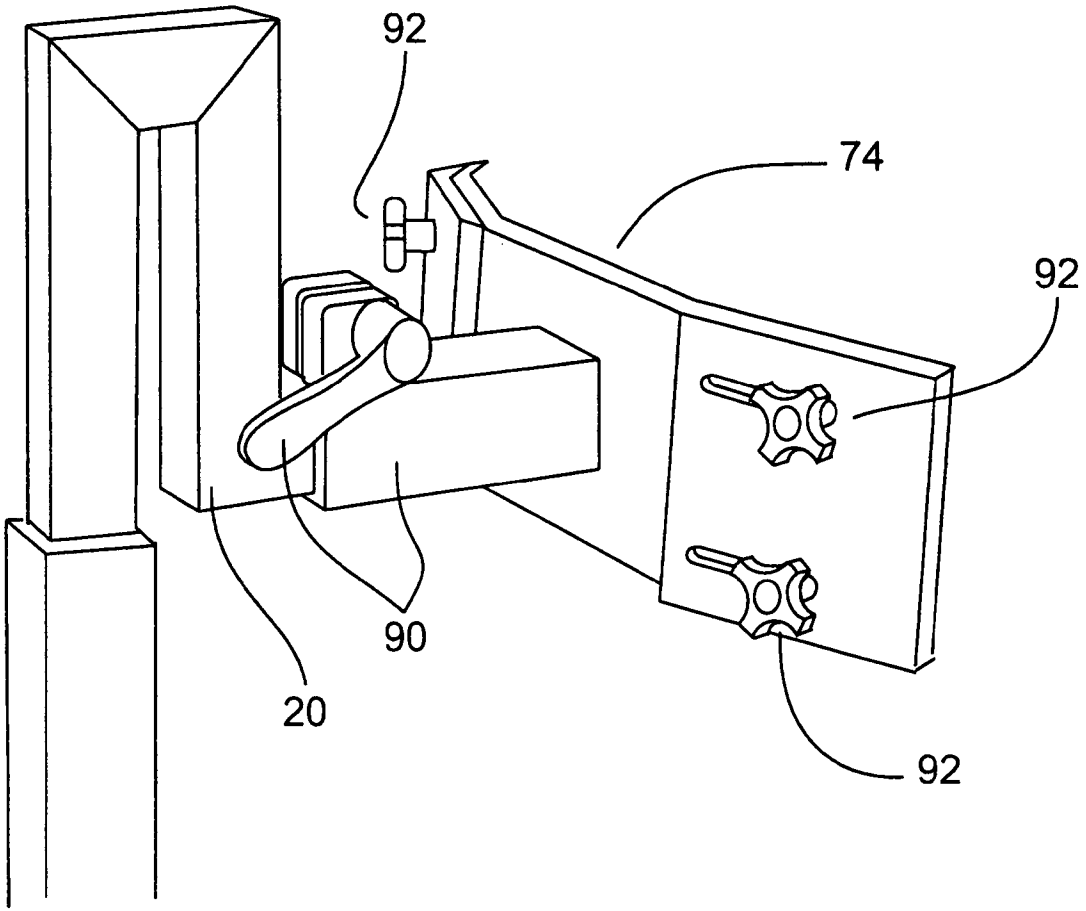
FIG. 9 is a sectional view showing the preferred embodiment of a control for the adjustable lower back support.

FIG. 9 is a sectional view showing the preferred embodiment of a control for the adjustable lower back support. FIG. 9 shows adjustable lower back control 90 connected and positioned between lower back arm 20 and lower back support 74. Controls 92 provide adjustments for the hip size of the user.

Figure 10:
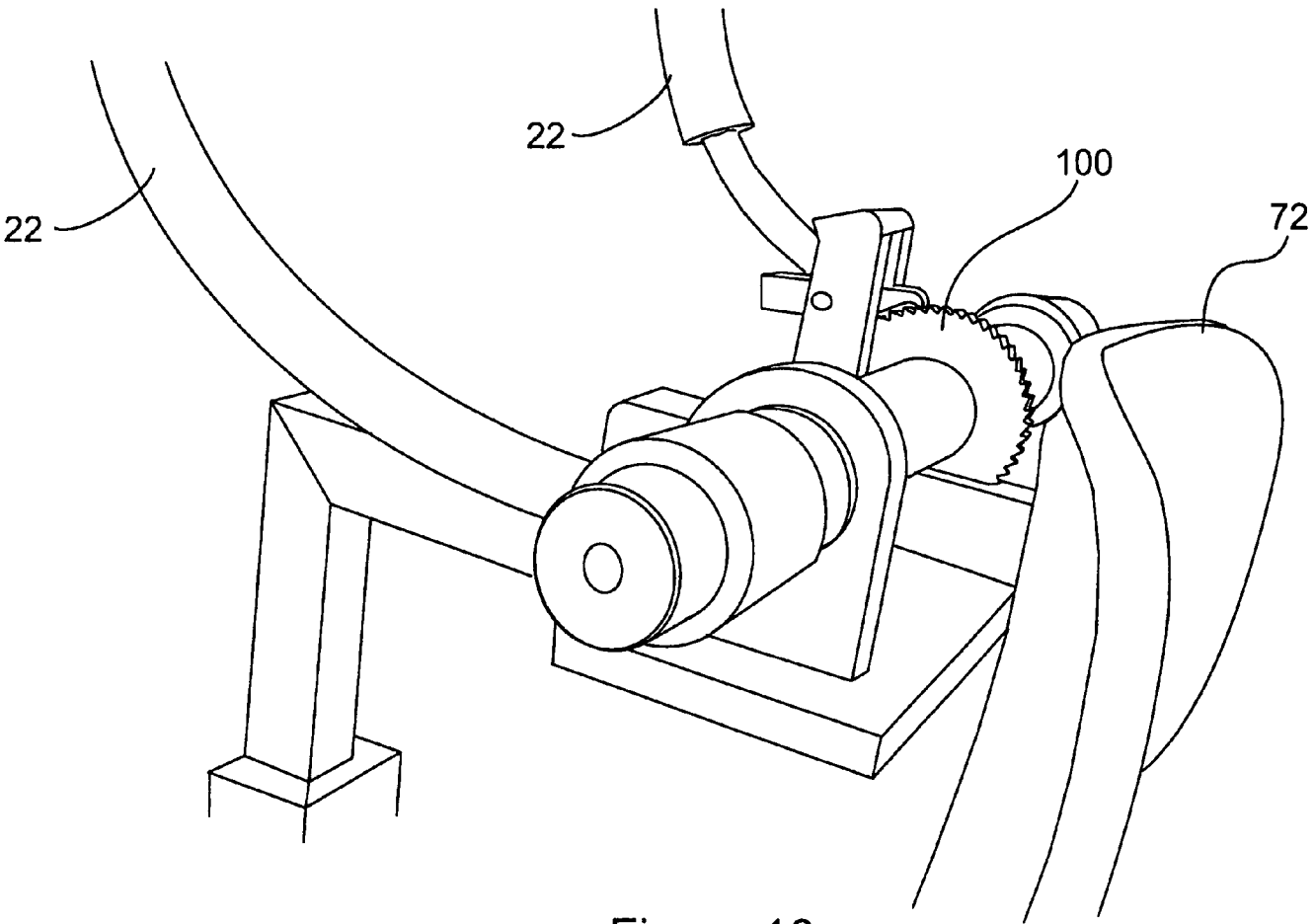
FIG. 10 is a sectional view showing the preferred embodiment of a ratchet for the shoulder harness.

FIG. 10 is a section view showing the preferred embodiment of a ratchet for the shoulder harness. FIG. 10 shows ratchet 100 for shoulder harness 22 and upper back support 72.

Figure 11:
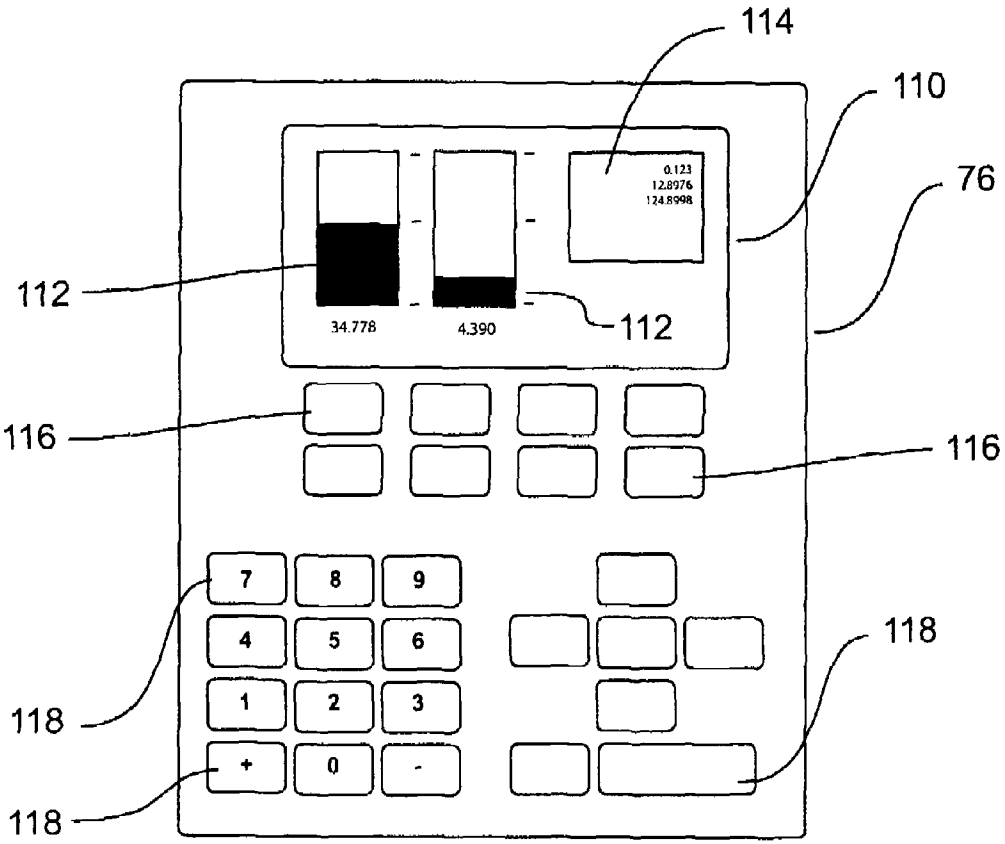
FIG. 11 is a sectional view showing the preferred embodiment of a real time position display.

FIG. 11 is a section view showing the preferred embodiment of real time position display unit 76. Display unit 76 includes run screen 110, current status screen 112, cycle in use screen 114, soft key functions 116 and conventional key pad 118.

Figure 12:
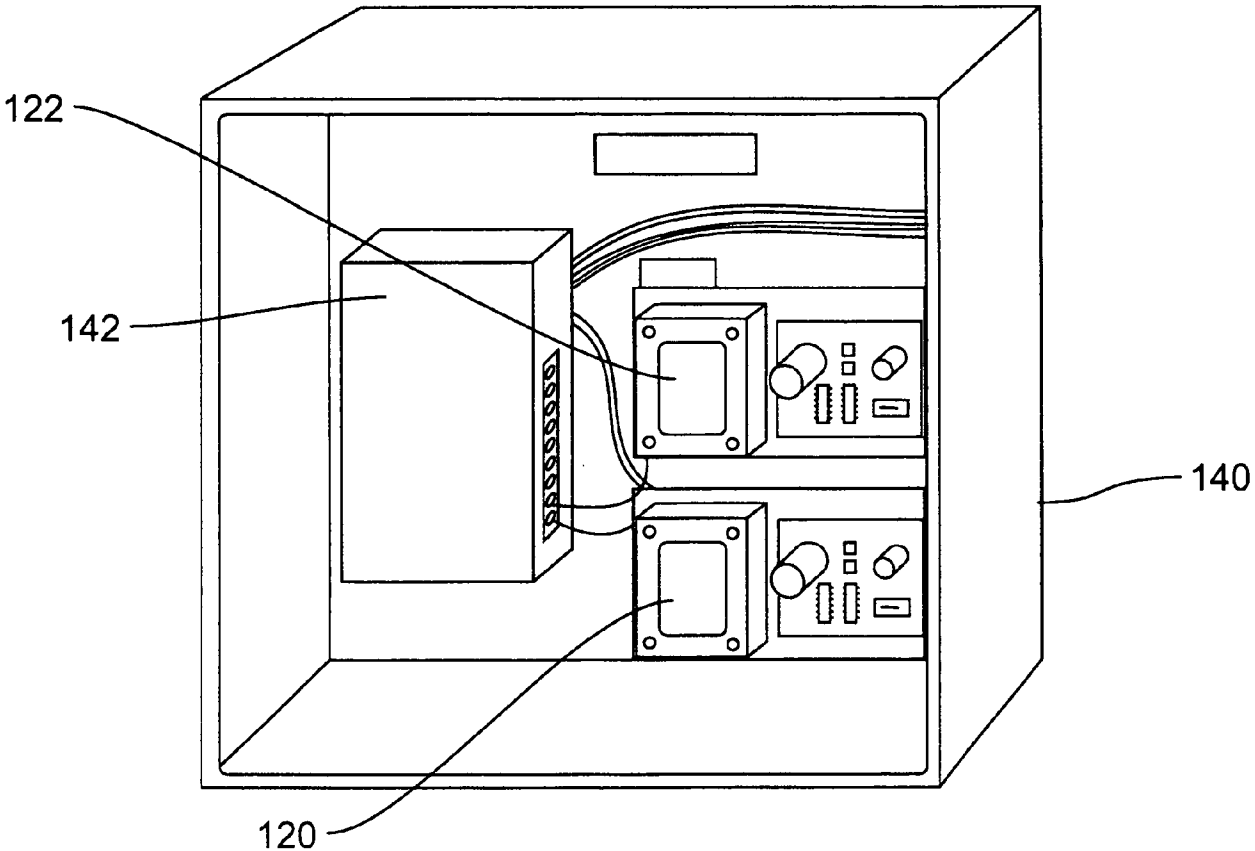
FIG. 12 is a sectional view showing the preferred embodiment for the controls for the magnetic brakes.

FIG. 12 is a sectional view showing the preferred embodiment of magnetic brake controls. FIG. 12 shows control unit 140 including magnetic brake controls 120 and 122. Controls 120 and 122 are connected to control unit 140, computer 142 and magnetic brakes 80 and 82 through conventional circuitry, not shown.

In one embodiment, we employ a computer chip that tracks all aspects of performance over time. In this embodiment, a means measures at least one or all aspects of performance and converts the performance into an electrical signal representative of the performance being monitored. A programmed microprocessor including the computer chip is configured to identify the signal representative of the performance being monitored. The programmed microprocessor also is configured to identify and store the parameter (performance) being monitored. This enhanced version allows the professional to track their students. It also is used for the physical therapist and chiropractor to monitor a patient.

In another embodiment, shoulder harness 22 is not a true harness connected to a user's shoulders by a means such as a strap or belt. Preferably, shoulder harness 22 has a distal end with handles attached thereto. The user grasps the handles during use of apparatus 10.

In still another embodiment, base 14 includes sensors which provide signals to the programmed microprocessor. These, for example, would help a PGA Professional, to monitor a student's weight shift during a golf swing. Knowing if a right handed golfer's weight is on the inside of the right foot at the top of the back swing would be a valuable teaching tool. Monitoring a weight shift to the outside of the left foot at the completion of the follow through would be equally valuable.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. An apparatus (10) that provides resistance using dynamic movement for shoulder, hip, knee, back, abdominal and leg musculature to strengthen muscles of the axial skeleton and lower extremities of a performing user, comprising:

a support base (14);

a member (16) mounted to the support base (14);

an axial assembly (17) pivotally mounted to the member (16);

a variable resistance, pivotally mounted, torso engaging arm (18) coupled to the pivotally mounted axle assembly (19);

a variable resistance, pivotally mounted, pelvis engaging arm (20) coupled to the pivotally mounted axle assembly (19);

a shoulder engaging harness (22) connected to the torso engaging arm (18);

a hip engaging harness (24) connected to the pelvis engaging arm (20);

an independent torque resistor (26) connected to the torso engaging arm (18); and an independent torque resistor (28) connected to the pelvis engaging arm (20).

2. An apparatus according to claim 1 including means to independently lock the torso engaging arm (18) in a neutral position.

3. An apparatus according to claim 1 including means to independently lock the pelvis engaging arm (20) in a neutral position.

4. An apparatus according to claim 1 wherein the torque resistor (26) provides variable resistance in at least two directions.

5. An apparatus according to claim 1 wherein the torque resistor (28) provides variable resistance in at least two directions.

6. An apparatus according to claim 1 wherein the torque resistor (26) is a brake.

7. An apparatus according to claim 1 wherein the torque resistor (28) is a brake.

8. An apparatus according to claim 1 including a real time display unit configured for measuring at least one or all aspects of performance of the performing user and converting the measured performance into a representation of a screen display of the measured performance.

9. An apparatus according to claim 1 including an upper back support connected to the torso engaging arm (18).

10. An apparatus according to claim 9 including a ratchet (100) for a shoulder harness (22) and the upper back support connected between the torso and the shoulder harness (22).

11. An apparatus according to claim 1 including a lower back support connected to the pelvis engaging arm (20).

12. An apparatus according to claim 11 including a control for adjustable lower back support connected and positioned between the pelvis engaging arm (18) and a hip harness (24).

13. An apparatus according to claim 1 including an adjustable torso angle control (17) connected to the member (16) mounted to the support base (14).

14. An apparatus according to claim 1 wherein the torque resistor (26) is a magnetic brake and wherein the pelvis torque resistor (28) is a magnetic brake.

15. An apparatus according to claim 14 including a magnetic brake controllers configured to control the magnetic brakes (26) and (28).

16. A golf exercise apparatus (10) that provides resistance during an exercise emulating the movements required of a golf swing of a golfer to strengthen muscles of the axial skeleton and lower extremities of the golfer performing the exercise, comprising:

a support base (14);

a member (16) mounted to the support base (14);

an axial assembly (19) pivotally mounted to the member (16);

a variable resistance, pivotally mounted, torso engaging arm (18) coupled to the pivotally mounted axle assembly (19);

a variable resistance, pivotally mounted, pelvis engaging arm (20) coupled to the pivotally mounted axle assembly (19);

a shoulder engaging harness (22) connected to the torso engaging arm (18);

a hip engaging harness (24) connected to the pelvis engaging arm (20);

an independent torque resistor (26) connected to the torso engaging arm (18); and an independent torque resistor (28) connected to the pelvis engaging arm (20);

wherein the torque resistor (26) is a brake and wherein the torque resistor (28) is a brake.

17. An apparatus according to claim 16 wherein the brakes are a disc brake or a magnetic brake.

18. An apparatus according to claim 17 wherein the disc brakes are dry friction, fluid damping, eddy current, or magneto-heterodyne brakes.

19. A golf exercise apparatus (10) that provides resistance during an exercise emulating the movements required of a golf swing of a golfer to strengthen muscles of the axial skeleton and lower extremities of the golfer performing the exercise, comprising:

a support base (14);

a member (16) mounted to the support base (14);

an axial assembly (19) pivotally mounted to the member (16);

a variable resistance, pivotally mounted, torso engaging arm (18) coupled to the pivotally mounted axle assembly (19);

a variable resistance, pivotally mounted, pelvis engaging arm (20) coupled to the pivotally mounted axle assembly (19);

a shoulder engaging harness (22) connected to the torso engaging arm (18);

a hip engaging harness (24) connected to the pelvis engaging arm (20);

an independent torque resistor (26) connected to the torso engaging arm (18); and an independent torque resistor (28) connected to the pelvis engaging arm (20);

wherein each of the torso engaging arm 18 and the pelvis engaging arm (20) include an angle sensing device to independently measure the golfer's angular position.

20. An apparatus according to claim 19 wherein the angle sensing device is potentiometer or optical encoder.

21. An apparatus according to claim 20 wherein the potentiometer is a linear or rotary device.

22. A golf exercise apparatus (10) that provides resistance during an exercise emulating the movements required of a golf swing of a golfer to strengthen muscles of the axial skeleton and lower extremities of the golfer performing the exercise, comprising:

a support base (14);

a member (16) mounted to the support base (14);

an axial assembly (19) pivotally mounted to the member (16);

a variable resistance, pivotally mounted, torso engaging arm (18) coupled to the pivotally mounted axle assembly (19);

a variable resistance, pivotally mounted, pelvis engaging arm (20) coupled to the pivotally mounted axle assembly (19);

a shoulder engaging harness (22) connected to the torso engaging arm (18);

a hip engaging harness (24) connected to the pelvis engaging arm (20);

an independent torque resistor (26) connected to the torso engaging arm (18);

an independent torque resistor (28) connected to the pelvis engaging arm (20);

means to independently lock the engaging arm (18) in a neutral position; and means to independently lock the pelvis engaging arm (20) in a neutral position.

23. A golf exercise apparatus (10) that provides resistance during an exercise emulating the movements required of a golf swing of a golfer to strengthen muscles of the axial skeleton and lower extremities of the golfer performing the exercise, comprising:

a support base (14);

a member (16) mounted to the support base (14);

an axial assembly (19) pivotally mounted to the member (16);

a variable resistance, pivotally mounted, torso engaging arm (18) coupled to the pivotally mounted axle assembly (19);

a variable resistance, pivotally mounted, pelvis engaging arm (20) coupled to the pivotally mounted axle assembly (19);

a shoulder engaging harness (22) connected to the torso engaging arm (18);

a hip engaging harness (24) connected to the pelvis engaging arm (20);

an independent torque resistor (26) connected to the torso engaging arm (18); and an independent torque resistor (28) connected to the pelvis engaging arm (20);

wherein the torque resistor (26) provides variable resistance in at least two directions and wherein the torque resistor (28) provides variable resistance in at least two directions.

24. A golf exercise apparatus (10) that provides resistance during an exercise emulating the movements required of a golf swing of a golfer to strengthen muscles of the axial skeleton and lower extremities of the golfer performing the exercise, comprising:

a support base (14);

a member (16) mounted to the support base (14);

an axial assembly (19) pivotally mounted to the member (16);

a variable resistance, pivotally mounted, torso engaging arm (18) coupled to the pivotally mounted axle assembly (19);

a variable resistance, pivotally mounted, pelvis engaging arm (20) coupled to the pivotally mounted axle assembly (19);

a shoulder engaging harness (22) connected to the torso engaging arm (18);

a hip engaging harness (24) connected to the pelvis engaging arm (20);

an independent torque resistor (26) connected to the torso engaging arm (18); and an independent torque resistor (28) connected to the pelvis engaging arm (20);

wherein the torso engaging arm (18) includes a torque transducer to independently measure the golfer's exerted force.

* * * * *